US012753481B2

(12) United States Patent
Patgunarajah et al.

(10) Patent No.: US 12,753,481 B2
(45) Date of Patent: Oct. 6, 2026

(54) METHOD TO PRODUCE POROUS SEGMENTED THERMAL BARRIER COATING AND A POROUS SEGMENTED THERMAL BARRIER COATING

(71) Applicant: Siemens Energy Global GmbH & Co. KG, Munich (DE)

(72) Inventors: Roy Patgunarajah, Berlin (DE); Dimitrios Zois, Fort Mill, SC (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 187 days.

(21) Appl. No.: 18/704,740

(22) PCT Filed: Oct. 7, 2022

(86) PCT No.: PCT/EP2022/077882

§ 371 (c)(1),
(2) Date: Apr. 25, 2024

(87) PCT Pub. No.: WO2023/078633

PCT Pub. Date: May 11, 2023

(65) Prior Publication Data

US 2025/0034693 A1 Jan. 30, 2025

(30) Foreign Application Priority Data

Nov. 8, 2021 (EP) ..... 21206849

(51) Int. Cl.

| | |
|---|---|
| ***C23C 4/11*** | (2016.01) |
| ***C23C 4/129*** | (2016.01) |
| ***C23C 4/134*** | (2016.01) |

(52) U.S. Cl.
CPC ..... *C23C 4/11* (2016.01); *C23C 4/129* (2016.01); *C23C 4/134* (2016.01)

(58) Field of Classification Search
CPC ... C23C 28/3215; C23C 28/3455; C23C 4/02; C23C 4/11; C23C 4/129; C23C 4/134; C23C 4/18
See application file for complete search history.

(56) References Cited

U.S. PATENT DOCUMENTS 5,705,231 A 1/1998 Nissley
6,316,078 B1 * 11/2001 Smialek ..... C23C 4/02 428/164

(Continued)

FOREIGN PATENT DOCUMENTS

CN 102245810 A 11/2011
CN 106061655 A 10/2016

(Continued)

OTHER PUBLICATIONS

JP 2001525015 A (Year: 2001).*

(Continued)

*Primary Examiner* — Lawrence D Ferguson
(74) *Attorney, Agent, or Firm* — Wolter Van Dyke Davis, PLLC

(57) ABSTRACT

A method to produce a segmented thermal barrier coating by spraying a partially stabilized Zirconia powder with grain sizes such as −125 μm+45 μm. A coating system includes a substrate, especially a nickel or cobalt based substrate, a bond coat on the substrate, especially a metallic bond coat, and a segmented thermal barrier coating produced by the method.

12 Claims, 1 Drawing Sheet

(56) References Cited

U.S. PATENT DOCUMENTS

| | | | |
|---|---|---|---|
| 2010/0098923 | A1 | 4/2010 | Freling |
| 2016/0348226 | A1 | 12/2016 | Chen |

FOREIGN PATENT DOCUMENTS

| | | | |
|---|---|---|---|
| EP | 1908856 | A2 | 4/2008 |
| EP | 3333279 | A1 | 6/2018 |
| WO | 2004029330 | A1 | 4/2004 |

OTHER PUBLICATIONS

PCT International Search Report and Written Opinion of International Searching Authority mailed Dec. 14, 2022 corresponding to PCT International Application No. PCT/EP2022/077882 filed Oct. 7, 2022.

* cited by examiner

METHOD TO PRODUCE POROUS SEGMENTED THERMAL BARRIER COATING AND A POROUS SEGMENTED THERMAL BARRIER COATING

CROSS REFERENCE TO RELATED APPLICATIONS

This application is the US National Stage of International Application No. PCT/EP2022/077882 filed 7 Oct. 2022, and claims the benefit thereof, which is incorporated by reference herein in its entirety. The International Application claims the benefit of European Application No. EP21206849 filed 8 Nov. 2021.

FIELD OF INVENTION

The invention relates to a method to produce a porous segmented thermal barrier coating and a porous segmented thermal barrier coating.

BACKGROUND OF INVENTION

The implementation of segmented thermal barrier coatings (S-TBC) on hot gas path metallic components of a combustor and/or turbine sections of gas turbines comes with a significant number of benefits compared to the porous TBC. Namely, it improves erosion resistance and increases thermal strain resistance as well as low roughness.

However, the dense microstructure of the segmented coatings comes also with the caveat of increased thermal conductivity due to their almost complete lack of porosity. This creates the demand for increased coating thickness to achieve adequate thermal protection of the underlying metal component.

Increased coating thickness can be a problem with rotating components such as blades, as it increases their weight and thus their momentum. Additionally, increased coating thickness complicates the manufacturability of the parts in processes such as cooling holes reopening.

Finally, as the temperature inlet temperature of the gas turbines increases, the implementation of bilayer segmented coatings is imminent. And the benefit of low roughness of the coating will turn into caveat, as its low roughness hinders the good bonding of the second upper coating onto the first under coating.

The problem has not been resolved up to now.

SUMMARY OF INVENTION

It is therefore the aim of the invention to overcome this problem.

The problem is solved by a method to produce porous segmented thermal barrier coating and by a porous segmented thermal barrier coating according to the claims.

DETAILED DESCRIPTION OF INVENTION

The description and the figures are only examples of the invention.

One critical factor that has been investigated with the manufacturing of segmented TBC's (S-TBC) is the powder particles size.

Additional experimentation with coarser particles sizes has proven that it is possible to produce vertical segmentation even in porous coatings.

Specifically, by using a standard cut PSZ powder, especially such as a −125 μm+45 μm, which is especially agglomerated and sintered (A&S) PSZ, especially a 8YSZ powder, it is possible, by adapting the spraying parameters in a manner that sufficient melting of the particles can be achieved, in order to produce through the developing stress a high number of vertical cracks, but at the same time to retain a sufficient degree of porosity in the coating More importantly, the surface roughness (Ra) of the porous segmented ceramic coatings increased to about Ra: 8 μm-10 μm from about Ra: 3 μm-5 μm compared to a produced TBC from a typical fused and crushed (F&C) powder, commonly used for segmented ceramic coatings.

The inventive S-TBC offers a porosity higher than 3%, and in this case with porosity more than 10%, vertical cracks, that travel transversely through the coating that and do not branch.

The novelty lies on the usage of a standard cut commercial agglomerated and sintered (A&S) powder to produce segmented TBCs.

Specifically, the advantages are especially:

1. The usage of a cut −125 μm+45 μm agglomerated and sintered (A&S) powder reduces the need to purchase special powder cuts to achieve segmented TBCs. That means reduced purchasing costs.
2. Porosity in the segmented TBCs means lower thermal conductivity, which in turn means that thinner coatings will be required to protect the underneath metallic component. That will benefit the design and manufacturability of the coatings, as well as it will reduce deposition times and manufacturing costs.
3. The greatest advantage comes though, with the increased roughness (Ra) achieved with the coarser agglomerated and sintered (A&S) powder, while maintaining a good, segmented microstructure: a roughness of Ra: 8 μm-10 μm achieved with this powder, greatly enhances the bonding of a possible upper layer onto the underlayer. This will significantly increase the robustness of bilayer segmented coatings, and greatly improve their endurance and life expectancy.

Figure 1:
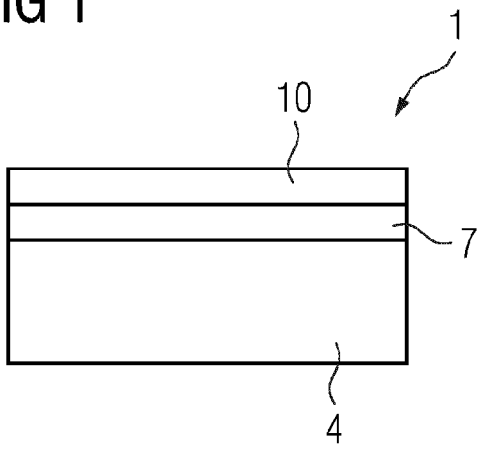
FIGS. 1, 2 show examples of inventive coating systems.
Figure 2:
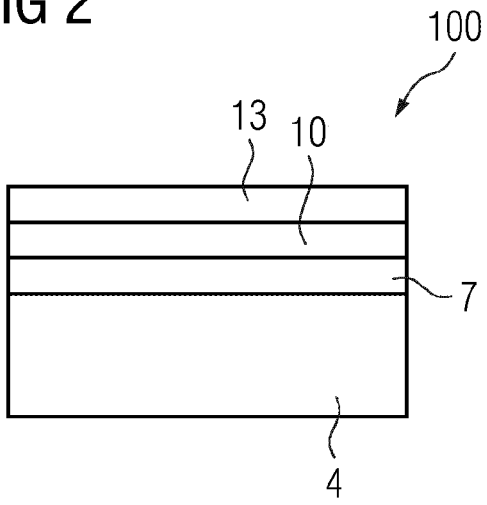

A coating system 1 using this S-TBC especially, comprises a substrate 4, which is especially metallic, very especially a nickel or cobalt based substrate, a bond coat 7 on the substrate 4, especially a metallic bond coat, very especially direct on the substrate (4), very especially a NiCoCrAlY—X (X=Ta, Re, Ru, Si), optionally a ceramic bonding layer between bond coat and S-TBC (not shown), which is not the TGO, and a segmented thermal barrier coating 10 produced with a cut −125 μm+45 μm agglomerated and sintered (A&S) powder As normal for FIGS. 1, 2 the bond coat produces or already reveals an oxide film (TGO).

Another possible coating system is as following: a substrate 4, which is especially metallic, very especially a nickel or cobalt based substrate, a bond coat 7 on the substrate, especially a metallic bond coat, very especially a NiCoCrAlY—X, wherein X is Ta, Re, Ru, Si, especially only Ta, a lower layer 7 which is a thermal barrier coating produced by the method or with a cut −125 μm+45 μm agglomerated and sintered (A&S) powder, and an upper ceramic layer 13 which is a segmented thermal barrier coating produced by fully stabilized Zirconia.

The fully stabilized zirconia used for the upper layer 13 is preferably a 48% Yttria stabilized Zirconia.

The invention claimed is:

1. A coating system, which comprises
a substrate,
a bond coat on the substrate,
a segmented thermal barrier coating,
wherein a lower layer is a thermal barrier coating and an upper ceramic layer is a segmented thermal barrier coating produced by fully stabilized Zirconia,
wherein the fully stabilized Zirconia used for the upper ceramic layer is a 48% Yttria stabilized Zirconia,
wherein the substrate comprises a nickel or cobalt based substrate,
wherein the segmented thermal barrier coating comprises a surface roughness of 8 μm-10 μm,
wherein the segmented thermal barrier coating has a porosity higher than 8%, and a maximum of 20%, and
wherein the segmented thermal barrier coating comprises vertical cracks that travel transversely through the segmented thermal barrier coating and that do not branch.

2. The coating system according to claim 1,
wherein a ceramic underlayer is present between the segmented thermal barrier coating and the bond coat.

3. The coating system according to claim 1,
wherein the bond coat on the substrate comprises a metallic bond coat.

4. The coating system according to claim 1,
wherein the segmented thermal barrier coating has a porosity higher than 10%.

5. The coating system according to claim 1,
wherein the bond coat comprises NiCoCrAlY—X (X=Ta, Re, Ru, Si).

6. The coating system according to claim 1,
wherein the bond coat comprises NiCoCrAlY—X (X=Ta).

7. A coating system, which comprises
a substrate;
a bond coat on the substrate;
a segmented thermal barrier coating;
wherein a lower layer is a thermal barrier coating and an upper ceramic layer is a segmented thermal barrier coating produced by fully stabilized Zirconia;
wherein the fully stabilized Zirconia used for the upper ceramic layer is a 48% Yttria stabilized Zirconia;
wherein the substrate comprises a nickel or cobalt based substrate;
wherein the segmented thermal barrier coating has a porosity higher than 8%, and a maximum of 20%; and
wherein the segmented thermal barrier coating comprises vertical cracks that travel transversely through the segmented thermal barrier coating and that do not branch.

8. A method to produce a coating system as claimed in claim 1, comprising:
spraying a partially stabilized Zirconia powder,
wherein grain sizes of the powder comprise −125 μm+45 μm.

9. The method according to claim 8,
wherein an agglomerated and sintered powder is used.

10. The method according to claim 8,
wherein a plasma spraying technique or a High Velocity Oxygen Fuel (HVOF) spraying technique is used.

11. The method according to claim 8,
wherein an Yttria stabilized Zirconia powder is used.

12. The method according to claim 11,
wherein an 8 wt % Yttria stabilized Zirconia powder is used.

* * * * *